US009010708B2

(12) United States Patent
Vasilev

(10) Patent No.: US 9,010,708 B2
(45) Date of Patent: Apr. 21, 2015

(54) CLIP FOR HOLDING TOOTHBRUSHES AND THE LIKE

(76) Inventor: Dimce Vasilev, Addison, IL (US)

( * ) Notice: Subject to any disclaimer, the term of this patent is extended or adjusted under 35 U.S.C. 154(b) by 1642 days.

(21) Appl. No.: 12/120,897

(22) Filed: May 15, 2008

(65) Prior Publication Data

US 2009/0283651 A1 Nov. 19, 2009

(51) Int. Cl.
*A47G 1/10* (2006.01)
*A47K 1/09* (2006.01)

(52) U.S. Cl.
CPC ..... *A47K 1/09* (2013.01)

(58) Field of Classification Search
USPC ..... D6/534; 248/37.6, 539, 316.7; 312/245; 206/15.3
See application file for complete search history.

(56) References Cited

U.S. PATENT DOCUMENTS

| | | | | | |
|---|---|---|---|---|---|
| 1,289,025 | A | * | 12/1918 | Wever | 206/362.3 |
| D62,726 | S | * | 7/1923 | Hines | D6/534 |
| D66,289 | S | * | 12/1924 | Hines | D6/534 |
| 1,588,781 | A | * | 6/1926 | Stoddard | 206/362.3 |
| 2,286,012 | A | * | 6/1942 | Rochow | 248/37.6 |
| 2,309,116 | A | * | 1/1943 | Hylen | 206/362.3 |
| 2,676,862 | A | * | 4/1954 | Swain | 312/207 |
| 2,707,052 | A | * | 4/1955 | Brown | 211/65 |
| 4,932,625 | A | * | 6/1990 | Hotchkiss, Jr. | 248/316.7 |
| 5,052,556 | A | * | 10/1991 | Wilkinson | 206/362.2 |
| 5,573,019 | A | * | 11/1996 | Hempel | 132/310 |
| D379,060 | S | * | 5/1997 | Laga | D8/373 |
| 5,655,673 | A | * | 8/1997 | Weterrings et al. | 211/75 |
| 5,695,165 | A | * | 12/1997 | Moriarty | 248/316.8 |
| D451,730 | S | * | 12/2001 | Henderson | D6/534 |
| D451,731 | S | * | 12/2001 | Henderson | D6/534 |
| D454,740 | S | * | 3/2002 | Baggott | D6/534 |
| D492,869 | S | * | 7/2004 | Henry | D6/534 |
| D498,958 | S | * | 11/2004 | Henry | D6/534 |
| 7,225,559 | B1 | * | 6/2007 | Padilla | 34/202 |
| D549,024 | S | * | 8/2007 | Fuentes | D6/534 |
| D569,150 | S | * | 5/2008 | Vasilev | D6/534 |
| 7,490,727 | B2 | * | 2/2009 | Spiers et al. | 211/89.01 |
| 2005/0016045 | A1 | * | 1/2005 | Lasher | 40/759 |

* cited by examiner

*Primary Examiner* — Bradley Duckworth

(57) ABSTRACT

A holder for the shaft of an implement such as a toothbrush, the holder comprising a substantially flat display surface with an upright frame at the outer periphery of the display surface. A pair of flexible arms extend from the base forming a generally circular grip between the arms, with an entry gap between the arms. A bias hump extends from the base into the circular grip between the arms.

14 Claims, 2 Drawing Sheets

CLIP FOR HOLDING TOOTHBRUSHES AND THE LIKE

BACKGROUND OF THE INVENTION

This invention relates to clips or holders, and in particular to a holder for a shaft of an implement, such as a toothbrush.

Clips or holders in the nature of the invention exist in many forms and materials. The invention is directed to a holder for a shaft, such as that of a toothbrush, which is simple yet universal for shafts of similar sizes.

SUMMARY OF THE INVENTION

The invention is directed to the holder for the shaft of an implement, with the holder comprising a base having a substantially flat display surface within an outer periphery. An upright frame element surrounds the display surface proximate the outer periphery. A pair of curved, flexible arms extends integrally from the base forming a generally circular grip between the arms, with each flexible arm being of diminishing thickness from the base to a distal terminus. An entry gap is provided between the termini of the arms, and a bias hump extends from the base into the circular gap between the arms.

In accordance with the preferred form of the invention, each flexible arm includes an exterior portion extending substantially normal to the base. For aesthetics and strength, there is a curved transition between the exterior of the arm and the base.

In the preferred form of the invention, the entry gap has a width about half of the width of the circular grip. In one form of the invention, the gap is approximately 0.1875", and the circular grip has a width of approximately 0.3750".

Preferably, the base is oval. An adhesive back is provided on the base to allow the holder to be adhesively secured to most flat surfaces.

The holder is preferably made from high density polypropylene or plastics having similar characteristics. The flexible arms are sufficiently rigid to hold a shaft, yet they are pliable to allow easy entry of a shaft into the grip.

For aesthetics and function, most portions of the holder are rounded. Each distal terminus is rounded to allow ease of entry and exit of a shaft through the entry gap into the circular grip.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
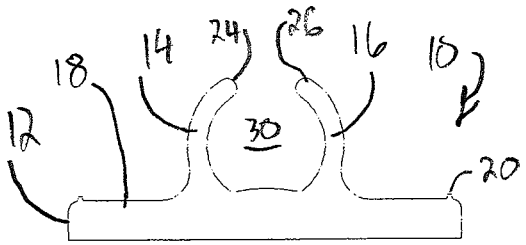
FIG. 1 is an end elevational view of a holder according to the invention.
Figure 2:
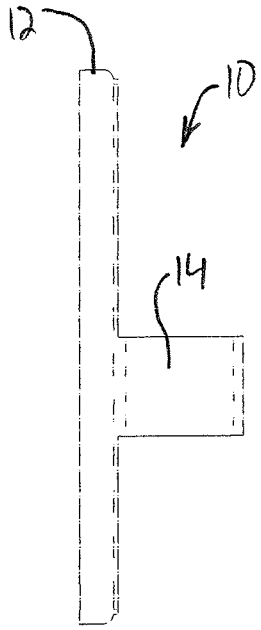
FIG. 2 is a side elevational view of the holder of FIG. 1.

A holder according to the invention is shown generally at 10 in the drawing figures. The holder 10 comprises a base 12 and a pair of curved, flexible arms 14 and 16 extending integrally from the base 12. Preferably, the holder 10 is molded from plastic, such as high density polypropylene or plastics exhibiting similar characteristics.

The base 12 includes a substantially flat display surface 18 extending to an outer periphery. An upright frame element 20 surrounds the display surface 20 proximate the outer periphery. The display surface is sufficiently flat so that an adhesive sticker (not illustrated) may be applied thereto for various purposes, such as advertising, use directions, or the like.

Figure 3:
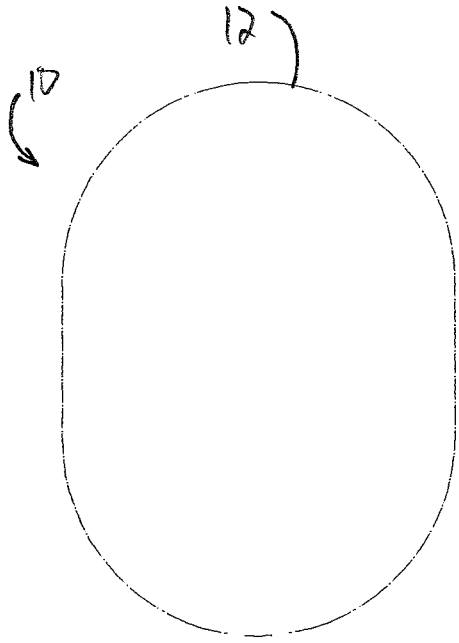
FIG. 3 is a rear elevational view of the holder according to the invention.

As shown in FIG. 3, preferably the base is oval, although it can assume other shapes. For affixing the base to a flat surface, the underside of the base 12 includes an adhesive back 22 which may include an overlying release so that the holder can be pressure-applied to a flat surface. If desired, the adhesive back 22 can be omitted, and glue or other adhesives can be applied to the back of the holder 12 when it is to be installed, or other types of fasteners can be used for affixing the holder 10 in place.

Each of the flexible arms 14 and 16 extends from the base 12 to a respective distal terminus 24 and 26. Each distal terminus 24 is rounded, as illustrated, and an entry gap 28 extends between the termini. The arms 14 and 16 form a generally circular grip 30 therebetween. Preferably, the entry gap 28 has a width about half of the width of the circular grip 30.

Preferably, also, each of the arms 14 and 16 is of slightly diminishing thickness once it has risen from the base 12 and extends to the respective distal termini 24 and 26. Since the holder 10 preferably is molded, having the arms diminish slightly in thickness allows easier extraction from a mold cavity.

Each of the arms 14 and 16 has a respective exterior portion 32 and 34 that is substantially normal to the base 12. For added strength, the transition between the base 12 and the arms 14 and 16 includes a respective radius 36 and 38 extending between the respective exterior portions 32, 34 and the base 12.

Figure 4:
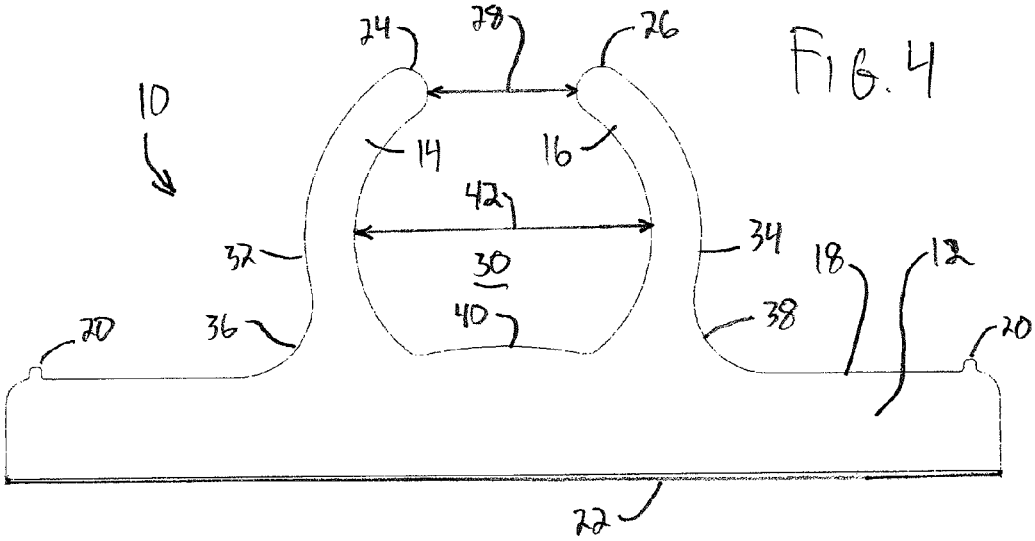
FIG. 4 is an enlarged end elevational view, the same as FIG. 1, in order to illustrate detail.

To aid in holding a shaft between the arms 14 and 16, a bias hump 40 extends from the base 12 into the circular grip 30. The arms 14 and 16 have a width 42 which, in the vertical direction (in relation to FIGS. 1 and 4) is diminished somewhat by the intrusion of the bias hump 40. Thus, any shaft held between the arms 14 and 16 is forced against the arms 14 and 16 by the bias hump 40, and is retained securely in place.

While the holder 10 can be of various dimensions, it is preferred that the holder be of sufficient size to grip a shaft of a toothbrush and the like. The following Table I sets forth preferred dimensions for the holder 10.

TABLE I

| Element | Dimension |
|---|---|
| Entry gap 28 | 0.1875" |
| Grip Width 42 | 0.3750" |
| Extent of arms 14, 16 from base 12 | 0.4850" |
| Length of base 12 | 1.750" |
| Width of base 12 | 1.250" |
| Bias hump 40 | 0.500" radius |
| Radius 36, 38 | 0.109" radius |

The invention provides a simple, yet robust shaft holder. Various changes can be made to the invention without departing from the spirit thereof or scope of the following claims.

What is claimed is:

1. A holder for a shaft of an implement, the holder comprising:

a. a base having a substantially flat display surface within an outer periphery, b. a continuous upright frame element surrounding said display surface proximate said outer periphery, c. a pair of curved, flexible and displaceable arms located within and spaced from said frame element and extending integrally from said flat display surface within said outer periphery, forming a generally circular grip between said arms, each flexible arm being solid and of diminishing thickness from said base to a distal terminus, d. an entry gap between the termini of said arms, and e. a bias hump forming part of and extending from said flat display surface into said circular grip between said arms.

2. The holder according to claim 1, in which each flexible arm includes an exterior portion extending substantially normal to said base.

3. The holder according to claim 1, in which said entry gap has a width about half of the circular grip.

4. The holder according to claim 3, in which said gap is approximately 0.1875 inches and said circular grip has a width of approximately 0.375 inches.

5. The holder according to claim 1, in which said base is oval.

6. The holder according to claim 1, including an adhesive back on said base.

7. The holder according to claim 1, in which the holder is made from high density polypropylene.

8. The holder according to claim 1, in which each distal terminus is rounded.

9. A holder for a shaft of an implement, the holder comprising a. a base having a substantially flat display surface within an outer periphery, b. continuous upright frame element surrounding said display surface proximate said outer periphery, c. a pair of curved, flexible and displaceable arms located within and spaced from said frame element and extending from said flat display surface within said outer periphery, forming a generally circular grip between said arms, each flexible arm being solid and of diminishing thickness from said base to a distal terminus, and each flexible arm including an exterior portion extending substantially normal to said base, d. each distal terminus being rounded, e. an entry gap between the termini of said arms, and f. a bias hump forming part of and extending from said flat display surface into said circular grip between said arms.

10. The holder according to claim 9, in which said entry gap has a width about half of the circular grip.

11. The holder according to claim 10, in which said gap is approximately 0.1875 inches and said circular grip has a width of approximately 0.375 inches.

12. The holder according to claim 9, in which said base is oval.

13. The holder according to claim 9, including an adhesive back on said base.

14. The holder according to claim 9, in which the holder is made from high density polypropylene.

* * * * *